US006132537A

United States Patent [19]

Zeuner et al.

[11] Patent Number: 6,132,537

[45] Date of Patent: Oct. 17, 2000

[54] AZIDE-FREE GAS-PRODUCING COMPOSITION

[75] Inventors: Siegfried Zeuner, München; Achim Hofmann, Polling; Roland Schropp, Tegernheim; Karl-Heinz Rödig, Kraiburg, all of Germany

[73] Assignee: TRW Airbag Systems GmbH & Co. KG, Aschau/Inn, Germany

[21] Appl. No.: 09/287,800

[22] Filed: Apr. 7, 1999

[30] Foreign Application Priority Data

Apr. 8, 1998 [DE] Germany ..... 298 06 504 U

[51] Int. Cl.[7] ..... C06B 31/00; C06B 31/02

[52] U.S. Cl. ..... 149/45; 149/61

[58] Field of Search ..... 149/45, 61, 75, 149/76, 77

[56] References Cited

U.S. PATENT DOCUMENTS

| | | | |
|---|---|---|---|
| 4,370,181 | 1/1983 | Lundstrom et al. | 149/2 |
| 5,197,758 | 3/1993 | Lund et al. | 280/741 |
| 5,431,103 | 7/1995 | Hock et al. | 102/287 |
| 5,592,812 | 1/1997 | Hinshaw et al. | 60/205 |
| 5,608,183 | 3/1997 | Barnes et al. | 149/45 |
| 5,635,668 | 6/1997 | Barnes et al. | 149/45 |

FOREIGN PATENT DOCUMENTS

| | | |
|---|---|---|
| 0767155 | 4/1997 | European Pat. Off. . |
| 29722912 | 4/1998 | Germany . |
| 29821541 | 4/1999 | Germany . |
| 9500462 | 1/1995 | WIPO . |
| 96261169 | 8/1996 | WIPO . |
| 97299927 | 8/1999 | WIPO . |

*Primary Examiner*—Michael J. Carone
*Assistant Examiner*—Aileen J. Baker
*Attorney, Agent, or Firm*—Tarolli, Sundheim, Covell, Tummino & Szabo L.L.P.

[57] ABSTRACT

The present invention provides a composition, in particular for use in safety devices for motor vehicles, which comprises a fuel mixture consisting of at least two components in a proportion of from 20 to 60% by weight and an oxidizer mixture consisting of at least three components in a proportion of from 40 to 80% by weight, relative to the total composition in each case. The composition is wherein the fuel mixture is composed of 5 to 95% by weight of a guanidine compound, 5 to 95% by weight of a heterocyclic organic acid, and 0 to 20% by weight of further fuels, relative to the fuel mixture in each case. According to the invention the oxidizer mixture is composed of 20 to 70% by weight of one or more transition-metal oxides, 10 to 50% by weight of basic copper nitrate, and 2 to 30% by weight of metal chlorate, metal perchlorate, ammonium perchlorate, alkali nitrate, alkaline-earth nitrate or mixtures thereof, relative to the oxidizer mixture in each case.

9 Claims, No Drawings

AZIDE-FREE GAS-PRODUCING COMPOSITION

The present invention relates to an azide-free gas-producing composition, in particular for use in safety devices for motor vehicles, comprising a fuel mixture consisting of at least two components in a proportion of from 20 to 60% by weight and an oxidizer mixture consisting of at least three components in a proportion of from 40 to 80% by weight, relative to the total composition in each case.

BACKGROUND OF THE INVENTION

Gas-producing compositions, which are used in safety devices for motor vehicles, generally consist of a fuel based on sodium azide and an oxidizing agent. Because of the toxicity of sodium azide, however, attempts have been made since the very beginning to find alternatives to the azide-containing gas-producing mixtures.

U.S. Pat. No. 5,608,183 describes a gas-producing mixture which contains between about 30 and 85% by weight of a fuel and between about 15 and about 70% by weight of an oxidizing agent. At least 60% by weight of the fuel consists of the nitrate of an acid polyamine or a $C_2$–$C_3$-alkyl diamine, such as for example the nitrates of urea, guanidine, aminoguanidine, diaminoguanidine, semicarbazide, ethylene diamine, propane-1,3-diamine, or propane-1,2-diamine or mixtures thereof. The oxidizing agent comprises at least 60% by weight of basic copper nitrate and/or cobalt triamine trinitrate. The processing of the mixture takes place in a wet process.

The gas-producing mixture known from U.S. Pat. No. 5,608,183, however, has an insufficient ignition ability as well as too low a combustion rate. In addition, since the combustion temperature of the mixture is above 1700 K, an increased portion of toxic gases can be detected in the gas mixture released. Processing the mixture in a wet process requires additional drying stages and is therefore costly.

Thus, there is a continued need for an improved azide-free gas-producing composition for use in safety devices for motor vehicles.

SUMMARY OF THE INVENTION

The present invention provides such a composition, which comprises a fuel mixture consisting of at least two components in a proportion of from 20 to 60% by weight and an oxidizer mixture consisting of at least three components in a proportion of from 40 to 80% by weight, relative to the total composition in each case. The composition is wherein the fuel mixture is composed of 5 to 95% by weight of a guanidine compound, 5 to 95% by weight of a heterocyclic organic acid, and 0 to 20% by weight of further fuels, relative to the fuel mixture in each case. According to the invention the oxidizer mixture is composed of 20 to 70% by weight of one or more transition-metal oxides, 10 to 50% by weight of basic copper nitrate, and 2 to 30% by weight of metal chlorate, metal perchlorate, ammonium perchlorate, alkali nitrate, alkaline-earth nitrate or mixtures thereof, relative to the oxidizer mixture in each case.

The guanidine compound is preferably selected from the group consisting of guanidine carbonate, guanidine nitrate, guanidine perchlorate, aminoguanidine nitrate, diaminoguanidine nitrate, triaminoguanidine nitrate, nitroguanidine or mixtures thereof.

The heterocyclic organic acid is preferably a cyclic organic compound with the general empirical formula $C_aH_bN_cO_d$, a being an integer between 1 and 5, b and c each being an integer between 1 and 6, and d being an integer between 0 and 6. In addition, the salts and derivatives of the cyclic organic compound can also be used. It is particularly preferred for the heterocyclic organic acid to be selected from the group consisting of cyanuric acid, isocyanuric acid, cyamelide, urazole, uracil, uramine, urazine, alloxan, alloxanic acid, alloxantin, xanthine, allantoin, barbituric acid, orotic acid, dilituric acid, triazolone, violuric acid, succinimide, dialuric acid, isodialuric acid, hydantoin, pseudohydantoin, imidazolone, pyrazolone, parabanic acid, furazan, ammeline, creatinine, maleic acid hydrazide, uric acid, pseudouric acid, guanazine, guanazole, melamine and the salts and derivatives thereof. The derivatives of the heterocyclic organic acid preferably contain the functional groups =O, —OH, —$NO_2$, —$CO_2H$, —$NH_2$ or combinations thereof.

The use of an at least two-component fuel mixture of a guanidine compound and a heterocyclic organic acid has been found to be advantageous for producing noxious emissions as low as possible in the gas mixture released. In addition, the compounds named generally have a melting point higher than 200° C. and are therefore extremely heat-stable. They thus meet the requirements of a high long-term and heat stability which are demanded of gas generator propellants. Furthermore, the compounds named generally have high negative standard enthalpy of formation $\Delta H_f$, as a result of which the amount of energy released during the combustion of the mixture and therefore also the combustion temperature of the mixture remain low.

In addition, an excessively high portion of carbon in the heterocyclic organic acid is not desired, since in this case an increased portion of oxidizing agent is required and the combustion temperature of the mixture also increases to an undesired degree as a result of the strongly exothermic formation of $CO_2$. Compounds with 5 or 6 ring atoms are therefore particularly suitable as the heterocyclic organic acid. The number of carbon atoms per molecule of the organic heterocyclic acid should preferably not be greater than 4. Compounds are particularly preferred which contain at most 3 carbon atoms per molecule. In individual cases, such as for example in compounds with fused ring systems, up to 5 carbon atoms can even be present. Examples of these are guanine, $C_5H_4N_5O$, or uric acid, $C_5H_4N_3O_3$.

Compounds such as guanazine, $C_2H_6N_6$, guanazole, $C_2H_5N_5$, or melamine, $C_3H_6N_6$, which do not contain oxygen, can also be used as the heterocyclic organic acid. It is likewise possible to use salts and derivatives of the heterocyclic organic acid. Suitable derivatives are in particular compounds with substituents which improve or only slightly affect the oxygen balance, such as for example =O, —OH, —$NO_2$, —$CO_2H$ and —$NH_2$.

The use of a small portion—as compared with the prior art—of basic copper nitrate as an oxidizing agent ensures that the gas-producing mixtures according to the invention have an improved ignition ability as well as a sufficiently high combustion rate. In addition, the combustion temperatures of the gas-producing mixtures according to the invention are below 1700 K, so that the proportion of nitrogen oxides and carbon monoxide in the mixture released is extremely low. The solid residues occurring upon combustion of the gas-producing mixtures according to the invention are characterized by an excellent retention capacity.

According to the invention it has been found that the ability of the solid combustion residues to be retained can be affected by controlling the combustion temperature and, in particular, the ratio between the metallic and non-metallic residues. It is advantageous to form residues which both firmly adhere to one another and are nevertheless sufficiently porous to allow the combustion gases to escape. Although it is desirable for various reasons to set low combustion temperatures of below 1700 K, by itself it is not sufficient to ensure the required retention of the solid combustion residues. Thus for example, in Comparative Example 1 described below, at a combustion temperature of 1708 K and with a metal proportion in the combustion residues of 37%, a residue is obtained which can be filtered only with difficulty and which is powdered under the combustion conditions. In the Example according to the invention, on the other hand, at a comparable combustion temperature of 1680 K but with a metal proportion of 69% in the combustion residues, a solid clinker is formed which is still present in tablet form after the combustion and which can thus be removed very easily from the gas flow. Because of the ready powdering and the formation of droplets of melted metal, the formation of exclusively metallic combustion residues—which is regarded as advantageous in the prior art—results in only a poor ability of the combustion residues to be retained. The metal proportion in the solid combustion residues of the compositions according to the invention is preferably from about 50 to 90% by weight.

It has likewise been found that an excessive proportion of basic copper nitrate in the oxidizer mixture is disadvantageous, since this results in an increase in the proportion of nitrous gases in the gas mixture occurring during the combustion in an undesired manner. The proportion of basic copper nitrate in the oxidizer mixture should therefore not exceed 50% by weight. The use of basic copper nitrate together with a transition-metal oxide is particularly preferred, in which case the basic copper nitrate and the transition-metal oxide are advantageously introduced in substantially equal parts. The preferred transition-metal oxide is CuO.

In addition to the oxidizers metal oxide and basic copper nitrate, the compositions according to the invention contain a small proportion of conventional oxidizers based on chlorates, perchlorates and/or nitrates. The combustion rates of the mixtures according to the invention can be controlled over a wide range by the addition of these conventional oxidizers. According to the invention the proportion of these conventional oxidizers is at most 30% by weight, relative to the oxidizer mixture, and preferably at most to 20% by weight, in order to keep as low as possible the combustion temperatures and the proportion of combustion residues which are difficult to condense. Thus, it is known for example that a high proportion of potassium perchlorate sharply increases the combustion temperatures and releases large quantities of potassium chloride which is present in the form of a gas under the combustion conditions. This gaseous potassium chloride cannot be removed from the combustion gases by filters and after condensation it leads to the undesired formation of smoke in the interior of the vehicle.

The compositions according to the invention can be processed dry, as a result of which it is possible to dispense with additional costly drying stages during the preparation of the compositions.

DESCRIPTION OF A PREFERRED EMBODIMENT

The invention is described below with reference to a particularly preferred Example, which is not, however, to be regarded as restricting.

Example 737.5 g micronized guanidine nitrate, 320 g of ground cyanuric acid, 641.25 g of finely ground copper oxide, 641.25 g of basic copper nitrate and 160 g of potassium perchlorate were weighed together into a ball mill, were ground for 3 hours and were mixed together. The mixture obtained in this way was directly pressed to form tablets of 6×2.4 mm without further processing steps. 130 g of the propellant tablets obtained in this way were loaded into a gas generator of conventional design and were ignited in a test can with a volume of 146 liters. The maximum pressure obtained in the test can amounted to 2.14 bar after 68 ms. The ignition ability and the combustion rate of the mixture were thus sufficiently high for use of the mixture in a gas generator for passenger airbags with a volume of from 130 to 150 liters.

The calculated combustion temperature of the mixture was 1683 K. The combustion residues had a metal proportion of 69.5% by weight and were present in the form of a solid clinker, retaining the original tablet form. The proportion of carbon monoxide in the combustion gas was 110 ppm and the proportion of nitrous gases was 30 ppm.

Comparative Example 1

28.2 parts of micronized guanidine nitrate, 10.1 parts of ground cyanuric acid, 49.1 parts of copper oxide and 12.6 parts of potassium perchlorate were ground as described in Example 1, were mixed together and pressed to form tablets. The calculated combustion temperature of the said mixture was 1708 K.

Although the mixture displayed a satisfactory ignition ability and a sufficiently high combustion rate in the can test, powdering of the solid combustion residues occurred. The metal proportion of the solid combustion residues was 36.8% by weight. The CO concentration in the combustion gas was 190 ppm, the $NO_x$ concentration 20 ppm.

Comparative Example 2

43.7 parts of micronized guanidine nitrate, 48.3 parts of finely ground copper oxide and 8.0 parts of potassium perchlorate were processed to form propellant tablets as described in Example 1. The propellant tablets obtained in this way were loaded into a conventional gas generator and were ignited in a test can.

The calculated combustion temperature of the mixture was 1792 K. The solid combustion residues were present in fragments, and the metal proportion of the combustion residues was 51.5% by weight. The ignition ability and the combustion rate of the mixture were sufficient. However, an undesirably high portion of toxic gases was measured in the combustion gases with a CO concentration of 255 ppm and an $NO_x$ concentration of 48 ppm.

Comparative Example 3

A mixture of 52.1 parts of guanidine nitrate and 47.9 parts of basic copper nitrate was prepared in accordance with the specification described in Example 1 of U.S. Pat. No. 5,608,153. The calculated combustion temperature of the said mixture was 1760 K.

The mixture was loaded into a conventional gas generator and was ignited in a test can. The mixture displayed a poor ignition ability and only a low combustion rate. The can pressure obtained was insufficient. The metal proportion of the solid combustion residues was 100%, it being possible to observe the formation of melted droplets.

We claim:

1. An azide-free gas-producing composition, in particular for use in safety devices for motor vehicles, comprising a fuel mixture consisting of at least two components in a proportion of from 20 to 60% by weight and an oxidizer mixture consisting of at least three components in a proportion of from 40 to 80% by weight, relative to the total composition in each case, wherein the fuel mixture is composed of:

5 to 95% by weight of a guanidine compound;

95 to 5% by weight of a heterocyclic organic acid, and 0 to 20% by weight of further fuels, relative to the fuel mixture in each case, and the oxidizer mixture is composed of:

20 to 70% by weight of one or more transition-metal oxides;

10 to 50% by weight of basic copper nitrate;

2 to 30% by weight of metal chlorate, metal perchlorate, ammonium perchlorate, alkali metal nitrate, alkaline-earth metal nitrate or mixtures thereof, relative to the oxidizer mixture in each case.

2. The composition according to claim 1, wherein the guanidine compound is selected from the group consisting of guanidine carbonate, guanidine nitrate, guanidine perchlorate, aminoguanidine nitrate, diaminoguanidine nitrate, triaminoguanidine nitrate, nitroguanidine or mixtures thereof.

3. The composition according to claim 1, wherein the heterocyclic organic acid is a cyclic organic compound having the general empirical formula $C_aH_bN_cO_d$, wherein a is an integer between 1 and 5, b and c are each an integer between 1 and 6, and d is an integer between 0 and 6, and comprising salts and derivatives thereof.

4. The composition according to claim 1, wherein the heterocyclic organic acid is selected from the group consisting of cyanuric acid, isocyanuric acid, cyamelide, urazole, uracil, uramine, urazine, alloxan, alloxanic acid, alloxantin, xanthine, allantoin, barbituric acid, orotic acid, dilituric acid, triazolone, violuric acid, succinimide, dialuric acid, isodialuric acid, hydantoin, pseudohydantoin, imidazolone, pyrazolone, parabanic acid, furazan, ammeline, creatinine, maleic acid hydrazide, uric acid, pseudouric acid, guanazine, guanazole, melamine and the salts and derivatives thereof.

5. The composition according to claim 4, wherein the derivatives of the heterocyclic organic acid contain the functional groups =O, —OH, —$NO_2$, —$CO_2H$, —$NH_2$ or combinations thereof.

6. The composition according to claim 1, wherein the transition-metal oxide is selected from the group consisting of $Cr_2O_3$, $MnO_2$, $Fe_2O_3$, $Fe_3O_4$, CuO, $Cu_2O$ or mixtures thereof.

7. The composition according to claim 1, further comprising processing agents in a proportion of up to 5% by weight, relative to the total composition, wherein the processing agents are selected from the group consisting of flowing agents, compressing aids and/or lubricants.

8. The composition according to claim 1, consisting of from 20 to 40% by weight of guanidine nitrate, from 5 to 30% by weight of cyanuric acid, from 15 to 35% by weight of CuO, from 15 to 35% by weight of basic copper nitrate and from 4 to 16% by weight of $KClO_4$, relative to the total composition in each case.

9. The composition according to claim 1, wherein during combustion of the composition condensed combustion products are formed which have a proportion of metal of from 50 to 90% by weight.

* * * * *